US006732814B2

(12) United States Patent
Heinonen et al.

(10) Patent No.: US 6,732,814 B2
(45) Date of Patent: May 11, 2004

(54) ROCK DRILLING MACHINE

(75) Inventors: Jarmo Heinonen, Tampere (FI); Jorma Mäki, Mutala (FI)

(73) Assignee: Sandvick Tamrock Oy, Tampere (FI)

( * ) Notice: Subject to any disclaimer, the term of this patent is extended or adjusted under 35 U.S.C. 154(b) by 0 days.

(21) Appl. No.: 10/290,275

(22) Filed: Nov. 8, 2002

(65) Prior Publication Data

US 2003/0075346 A1 Apr. 24, 2003

Related U.S. Application Data

(63) Continuation of application No. PCT/FI01/00452, filed on May 10, 2001.

(30) Foreign Application Priority Data

May 11, 2000 (FI) ..... 20001124

(51) Int. Cl.[7] ..... B25D 17/00
(52) U.S. Cl. ..... 173/199; 173/198; 173/133
(58) Field of Search ..... 173/71, 73, 77, 173/78, 80, 198, 199, 104, 105, 111, 132, 133

(56) References Cited

U.S. PATENT DOCUMENTS 752,819 A * 2/1904 Brothers ..... 173/199
1,154,642 A * 9/1915 Lawton ..... 175/122
1,382,779 A * 6/1921 Gilman ..... 173/63
1,470,074 A * 10/1923 Gomez ..... 173/91
1,868,650 A * 7/1932 Wilhelm ..... 173/141
1,893,203 A * 1/1933 Hansen ..... 173/199
1,911,947 A * 5/1933 Ffuehrer ..... 279/20
2,778,605 A * 1/1957 Hunn ..... 173/78
3,409,086 A * 11/1968 Meyer ..... 173/9
3,797,584 A 3/1974 Bailey et al.
4,846,289 A * 7/1989 Heinonen ..... 173/162.1
5,307,881 A * 5/1994 Kimberlin ..... 173/62
5,330,012 A 7/1994 Morrison

FOREIGN PATENT DOCUMENTS

GB 2 157 219 A 10/1985
GB 2 314 795 A 1/1998
JP 7-158378 6/1995

* cited by examiner

*Primary Examiner*—Scott A. Smith
*Assistant Examiner*—Nathaniel Chukwurah
(74) *Attorney, Agent, or Firm*—Burns, Doane, Swecker & Mathis, LLP

(57) ABSTRACT

A rock drilling machine comprising a rotating device (1), a percussion device (2) and a shank (17) where a tool (18) is to be fastened. According to the inventive idea, lubricant used for lubricating the shank is supplied in suitable conduits to pressurize the holes (3*a*′–3*f*′) of coupling bolts that join together the different parts of the drilling machine and delivered further in suitable conduits to serve as lubricant on the bearing surfaces between the rock drill and the feed equipment (21).

8 Claims, 6 Drawing Sheets

ROCK DRILLING MACHINE

This application is a Continuation of International Application PCT/FI01/00452 filed on Oct. 5, 2001, which designated the U.S. and was published under PCT Article 21(2) in English.

FIELD OF THE INVENTION

The invention relates to a rock drilling machine comprising at least two blocks joined together with coupling bolts, which drilling machine further comprises a rotating device, a percussion device and a shank, and in which there is provided at least one feed conduit for delivering pressurized lubricant to the shank, the drilling machine being mounted on bearings to be movable with respect to feed equipment.

BACKGROUND OF THE INVENTION

In mining, rock drill apparatuses are used in which one or more drilling booms are arranged on a platform, the end of each boom being further provided with a feed beam and rock drill. The rock drilling machine comprises a percussion device and a rotating device which are conventionally joined together by means of binding bolts, the entity being then fastened to a separate carriage. The carriage in turn is arranged to be movable with respect to the feed beam and it is moved using feed means arranged to the feed beam. The carriage is usually provided with slide blocks serving as bearing surfaces between the carriage and the guides of the feed beam. The slide blocks are typically made of a bearing metal or plastic material. The slide blocks are usually not lubricated in any way, because they are wearing parts which are changed from time to time. However, slide blocks have been noticed to wear too quickly for example because of impurities that attach on the surfaces of the guides. To prevent the wearing, some manufacturers provide the feed mechanism with means to lubricate the slide surface between the guides and the slide blocks. This arrangement requires, however, a separate lubrication assembly and the related piping to be arranged to the feed beam. This causes extra costs and increased need for servicing. Moreover, a lubrication system arranged to the feed beam is subject to blows and impurities.

SUMMARY OF THE INVENTION

It is an object of the present invention to provide a novel arrangement for lubricating the bearing surfaces between a rock drilling machine and feed equipment and to prevent impurities from entering the rock drilling machine structure.

The rock drilling machine of the invention is characterized in that the rock drilling machine comprises at least one return conduit for delivering the lubricant used for lubricating the shank from the shank into at least some of the holes of the coupling bolts, whereby at least some of the spaces surrounding the coupling bolts being pressurized, and that the rock drilling machine further comprises at least one conduit for supplying the lubricant further to lubricate the bearing surface between the rock drill and the feed equipment.

An underlying idea of the invention is that the lubricant used for lubricating the shank is first delivered through conduits formed into the structure of the rock drill into the holes of the coupling bolts connecting the different blocks of the rock drilling machine, the lubricant pressurizing at least some of the coupling bolt spaces. In addition, the lubricant used for lubricating the shank is delivered to a feed mechanism, where it is used for lubricating the bearing surfaces between the feed equipment and the drilling machine.

An essential idea of an embodiment of the invention is that at least some of the coupling bolts are provided with longitudinal conduits in which the lubricant can be carried.

An advantage of the invention is that the lubrication of the bearing surfaces between the rock drill and the feed equipment is carried out using the lubricant leaving the shank, i.e. lubricant already used once, which would otherwise be discharged from the drilling machine into the air. Oil mist led into ambient air produces a gas cloud at the drilling site, thereby causing health risks to those working in the area. Oil mist also spreads far and dirties the drilling equipment and the environment. Because of these drawbacks, also drilling machines provided with separate collecting conduits for recovering the oil mist into a collecting container have been designed. However, the recovery system and its use (emptying and servicing) increase costs. In the present invention, the after-treatment of the lubricant is not a problem or a cause of extra cost, but, on the contrary, the lubricant allows the slide surfaces of the feed equipment to be efficiently lubricated without the need to build a separate lubrication assembly or to add extra lubricant. Moreover, the lubricant, particularly oil mist formed of pressurized air and lubricant, cleans the slide surfaces from impurities, which further reduces the wearing of the feeding devices. Since the oil mist is usually blown to metallic guides having a lower temperature than the oil mist, the oil may be condensed into droplets on the surface of the guides, whereby no significant amounts of oil mist is spread into ambient air. In the invention, the shank lubricant is also used for sealing the spaces of the coupling bolts that join the separate drilling machine blocks together. The oil mist pressurizes the spaces surrounding the coupling bolts, thereby blocking the entry of water, chippings and other impurities into the drilling machine structures through these spaces and thus preventing the wearing of the drilling machine. Further, if the seal between the joint surfaces becomes damaged or if the fastening of the blocks becomes looser over time, or due to any errors in servicing, the lubricant may fill any gaps between the joint surfaces and blows impurities outward.

BRIEF DESCRIPTION OF THE FIGURES

The invention will be described in greater detail with reference to the accompanying drawings, in which.

DETAILED DESCRIPTION OF THE INVENTION

Figure 1:
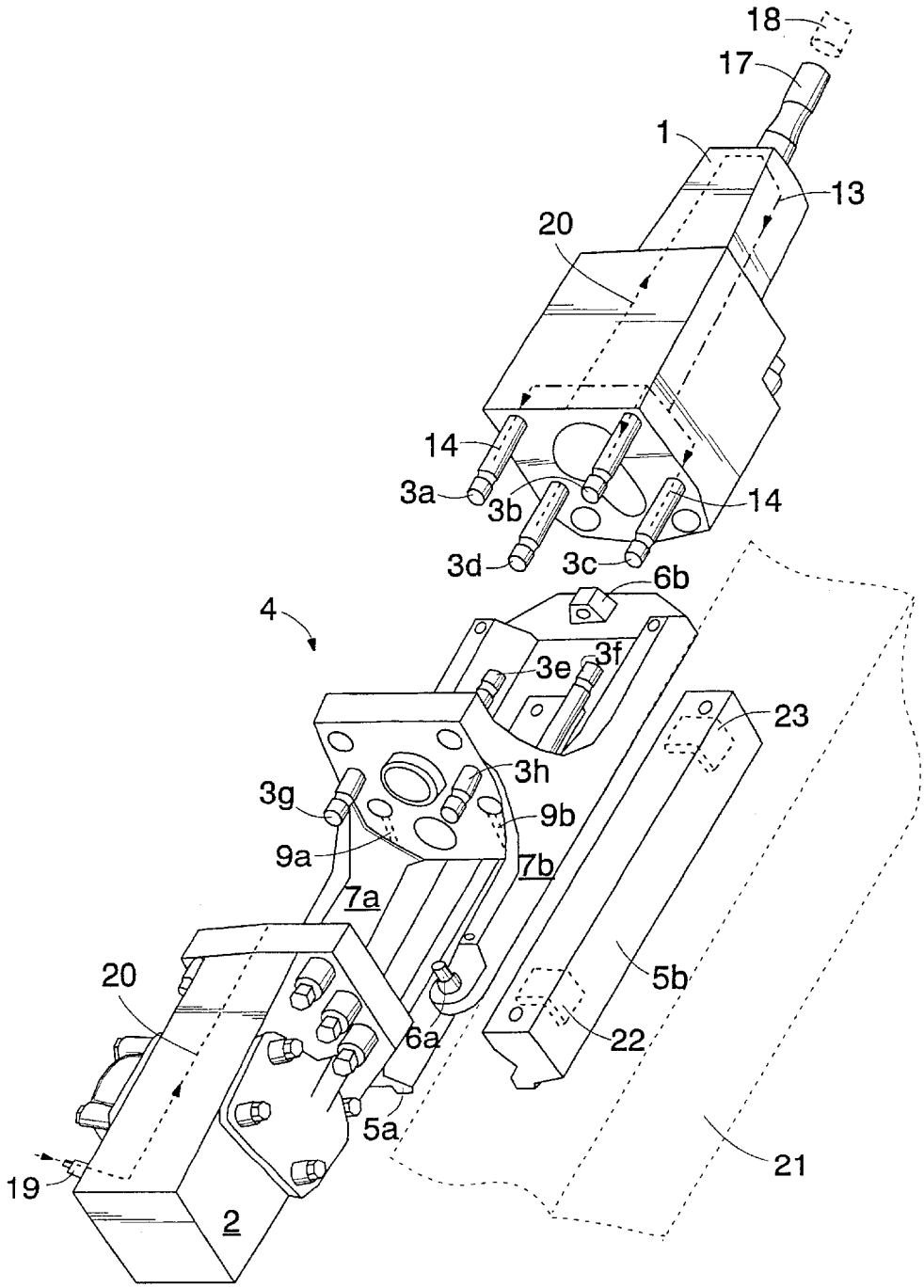
FIG. 1 is a schematic view of a disassembled rock drilling machine construction.

FIG. 1 shows a rock drilling machine which comprises a rotating device 1 arranged to its front end for rotating a shank 17 and a tool 18 fastened thereto. In addition, the drilling machine comprises a percussion device 2 used for causing blows to the tool. For the sake of clarity, the different parts of the drilling machine are shown detached. In the solution of FIG. 1, the rotating device and the percussion device are separate modules attached to a mounting frame 4 by means of coupling bolts 3*a*–3*h*. In this construction the mounting frame 4 is an essential part of the drilling machine construction because it serves as a member transmitting feed and recoil forces and as a mounting base for the modules. The mounting frame is used for mounting the rock drill to feed equipment 21 of the rock drilling apparatus, whereby a separate carriage conventionally used between the feed beam and the rock drill is not needed. The bottom surface of the mounting frame may be provided with slide blocks 5*a* and 5*b* comprising slide pieces 22 and 23 that allow the rock drill to be mounted on bearings to the feed equipment. The slide pieces can be made of a bearing metal or wear-resistant plastic material and they can be changed when they have been worn. In addition, the mounting frame comprises means 6*a* and 6*b* for connecting feed means, such as feed wires, to allow the rock drill to be moved.

At the front part of the rotating device there is the shank 17, arranged in a manner known per se, transmitting rotation and percussion forces to the drill rod, which is why the shank is one of the most critical parts of the drilling machine. The shank is typically lubricated and cooled using oil mist which may be supplied to the rear end of the rock drill by means of a lubrication port 19 and delivered in a supply conduit 20 towards to the front part of the rock drill, the lubricating oil being circulated at least through the shank surfaces that are to be lubricated. After the necessary lubrication has been completed, in prior art solutions the lubricant is discharged into air from the front part of the drilling machine. As already stated, this is problematic. In the solution of the invention, oil mist is used to pressurize the necessary coupling bolts spaces, after which it serves as a lubricant on the bearing surface between the rock drill and the feed beam. The shank oil may be circulated such that it is first delivered into the bolt holes and only finally to the bearing surfaces. This allows the number of conduits to be kept reasonable.

Figure 2:
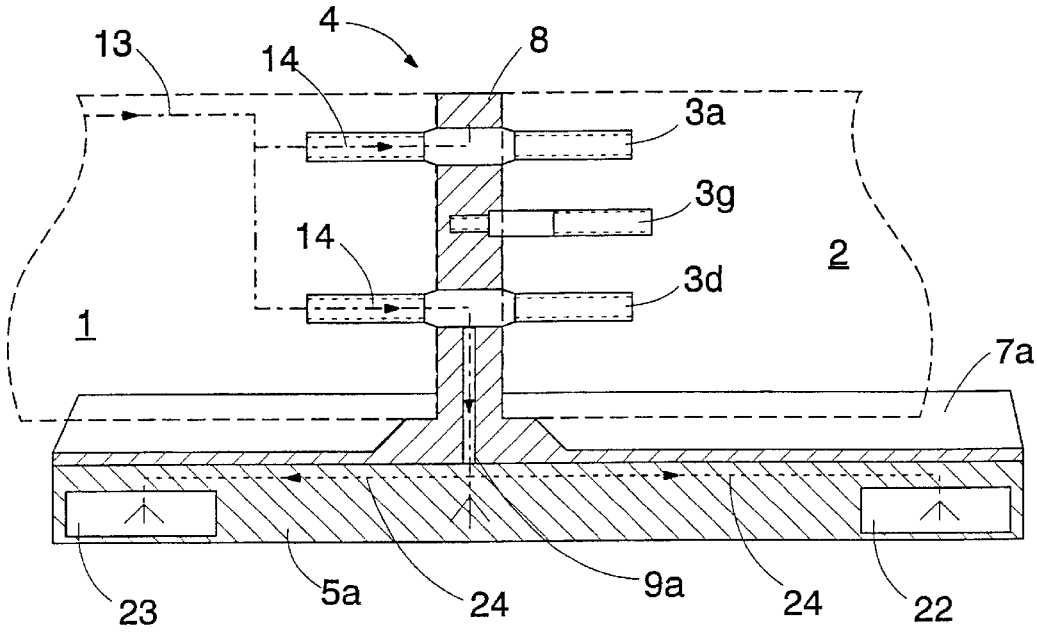
FIG. 2 is a schematic, sectional side view of a part of the rock drilling machine in the FIG. 1.

FIG. 2 shows a schematic sectional view of the drilling machine structure. As shown in FIGS. 1 and 2, the rotating device 1 may be fastened to the mounting frame with coupling bolts 3*a*–3*d* driven through an axial support 8 and further by means of bolts 3*e* and 3*f* screwed to the axial support. The percussion device 2 may also be fastened by means of bolts 3*a*–3*d* and, further, by means of bolts 3*g* and 3*h* screwed to the axial support. The bolts 3*a*–3*d* on the rotating device thus bind the rock drill modules together. Bolts 3*e* and 3*f* screwed to the mounting frame and, correspondingly, bolts 3*g* and 3*h* in turn secure the rotating and percussion devices in place even when bolts 3*a*–3*d* are unscrewn. According to the inventive idea, the rotating device comprises a return conduit 13 which carries the shank lubricant towards the rear end of the rotating device and further delivers the lubricant directly to each coupling bolt 3*a*–3*d*, as illustrated in FIGS. 1 and 2 with a line of dots and dashes. Coupling bolts 3*a*–3*d* may comprise a conduit 14 in which the oil mist is carried to the axial support 8. The shank lubricant thus pressurizes the space formed in the axial support between a coupling bolt and its hole, thereby preventing water and other impurities from flowing under the nut or through the joint surface into the bolt holes to penetrate into the rock drill. Naturally the oil mist can also be led to the axial support using only one coupling bolt for further delivery to each coupling bolt hole in conduits formed to the axial support. It is to be noted that sufficient pressurization of the coupling bolts is achieved when the pressure of the lubricant is higher than the pressure prevailing outside the rock drill. The free end of a coupling bolt may be provided with a seal, such as an O-ring, to prevent impurities from entering the rock drill through the bolt hole. The space around the coupling bolt may be pressurized up to the seal. If, for any reason, the seal is damaged, or no seals are used at all, the lubricant flows outward through the coupling bolt space, which also prevents the access of impurities. Further, the conduits of lower coupling bolts may be connected to conduits 9*a* and 9*b* formed to the axial support through which the oil mist is further supplied to the slide surface between the rock drill and the feed beam. The magnitude of the pressurization is influenced not only by the magnitude of the pressure of the oil mist coming from the shank but also by the flow resistance in the conduits leading to the slide surfaces. The rock drill may also comprise a valve, or the like, to allow the amount of oil mist to be supplied to the guides to be adjusted, when necessary. When the oil mist flow is throttled, the pressure acting on the pressurized surfaces increases. The slide block 5 may be provided with an opening through which the oil mist is supplied between the slide pieces 22 and 23 at the end of the slide block. Alternatively, the oil mist is supplied directly to the slide surface between the feed beam guide and the slide pieces in conduits 24 formed to the slide blocks.

Figure 3:
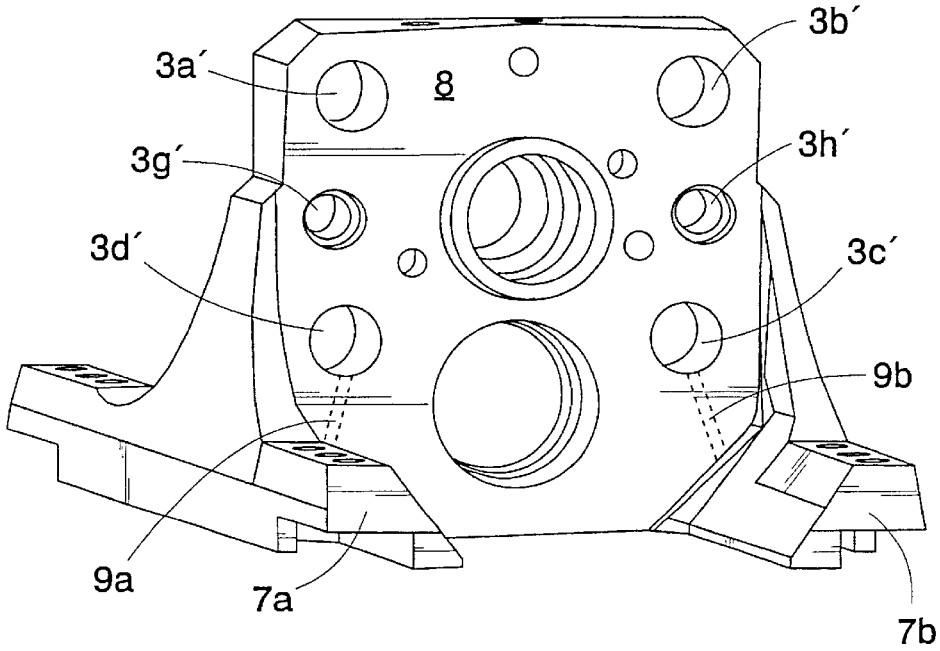
FIG. 3 is a schematic, perspective view of a mounting frame belonging to the rock drilling machine.

FIG. 3 shows the mounting frame used in the rock drilling machine when seen from the percussion device module. The axial support 8 may comprise through-drillings 3*a*′–3*d*′ and threaded blind holes 3*g*′ and 3*h*′ for the coupling bolts. According to the inventive idea, drillings 3*c*′ and 3*d*′ are connected to the conduits 9*a* and 9*b* leading to the slide blocks, the oil mist being carried in the conduits to the bearing surfaces of the feed equipment.

Figure 4:
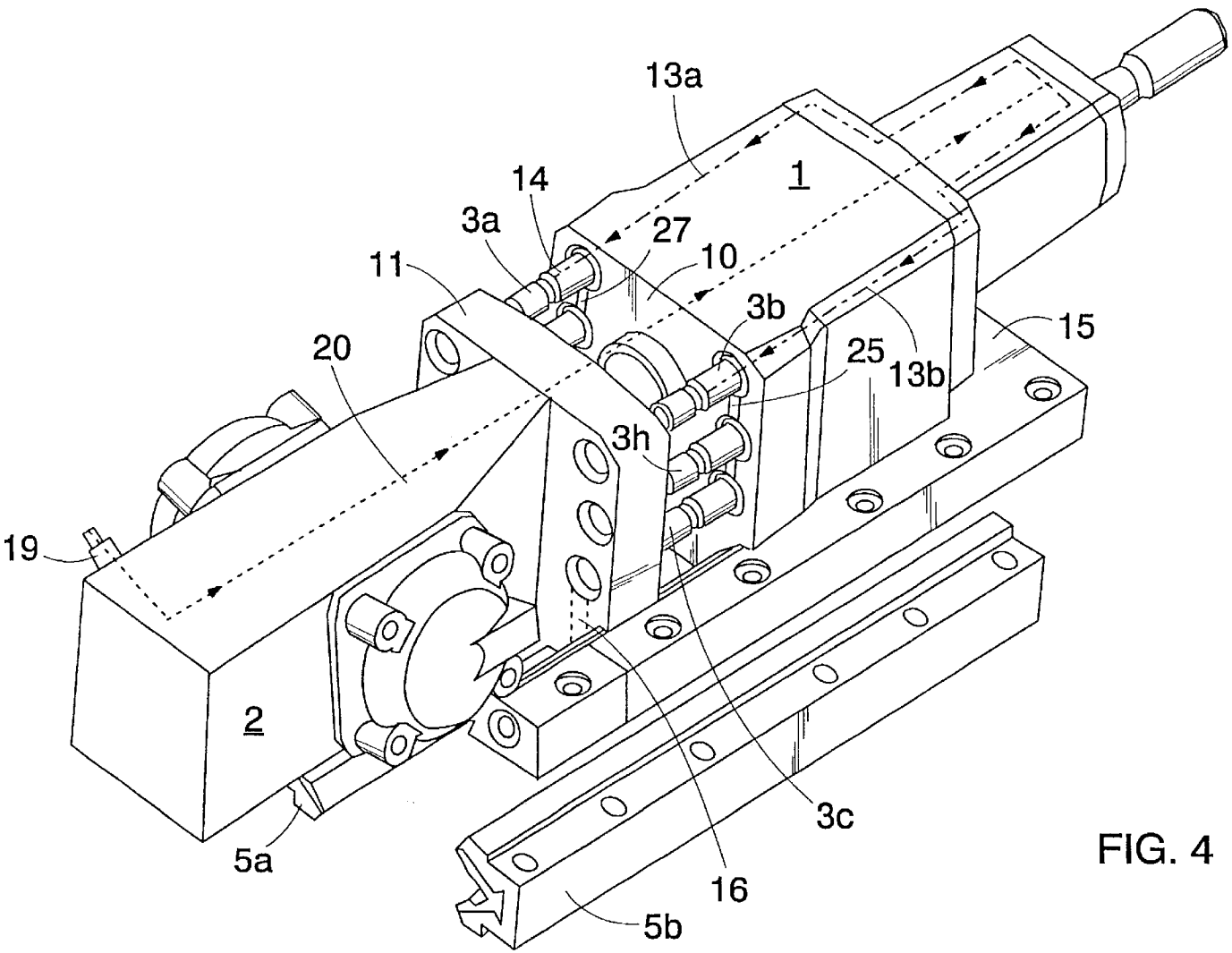
FIG. 4 is a schematic view of a rock drilling machine structure.

FIG. 4 shows another rock drilling machine construction in which the mounting frame consist of a substantially U-shaped bar 15 provided with a rotating device jacket arranged to its closed end. Further, the rear end of the jacket of the rotating device 1 is provided with a joint surface 10 for mounting the percussion device 2. The percussion device may be mounted to the joint surface 10 by means of coupling bolts 3*a*–3*d* and 3*g* and 3*h*. The Figure shows return conduits 13*a* and 13*b* drawn with a line of dots and dashes, the conduits being used for supplying the oil mist discharged from the shank to the upper coupling bolts 3*a* and 3*b* and further to the joint surface 10 in conduits 14 formed to the bolts. The joint surface 10 may be provided with vertical grooves 25 and 27 on which the lubricant is supplied from the spaces around the upper coupling bolts to the holes of the lower coupling bolts. The conduit 14 of the coupling bolts is further used to supply the lubricant to a mounting flange 11 of the percussion device module, whereby also the bolt holes formed to the mounting flanges are pressurized. In addition, the lubricant is supplied to the bearing surfaces in conduits 16 connected to the lowest bolt holes of the mounting flange.

Figure 5:
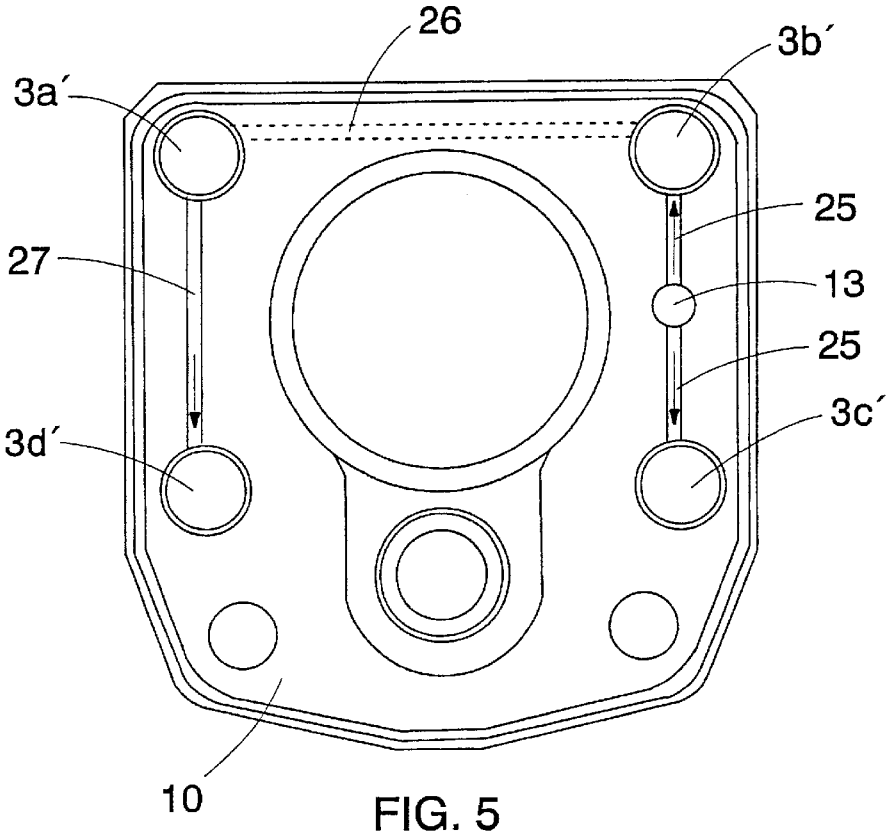
FIGS. 5, 6 and 7 are schematic views of alternative joint surfaces of a module belonging to the rock drilling machine.
Figure 9:
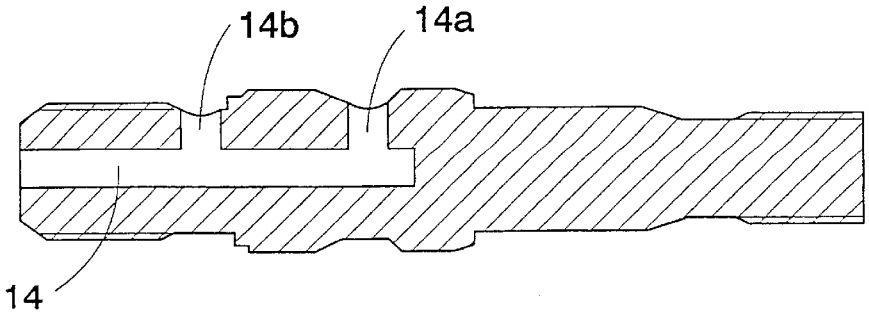

FIG. 5 shows a joint surface comprising the conduits needed for carrying the lubricant coming from the shank. In this case the return conduit 13 is directly connected from the front part of the rock drill to the joint surface 10 of the first block, the lubricant being led from there further on a groove 25 formed on the frontal surface to the upper and lower side bolts on the right-hand side of the drilling machine. The coupling bolts may be provided with conduits connected to the grooves which allows the lubricant to pass along the upper bolt 3*b* towards the front part of the drilling machine. At the front end of the first block, at a distance from the joint surface, there is provided a transverse drilling 26 connecting the holes 3*a*′ and 3*b*′ of the upper coupling bolts such that the lubricant is allowed to pass in the conduit provided in the coupling bolt 3*a* to the joint surface 10. Also on the left-hand side of the frontal surface, there is provided a vertical groove 27 on which the lubricant is allowed to pass on the frontal surface into the lower hole of coupling bolt 3*d*′. The coupling bolts employed in this construction are shown in FIG. 9, the coupling bolts allowing the lubricant to pass further from the joint surface in coupling bolt conduits 14*a*, 14 and 14*b* to the axial support of the mounting frame. The axial support comprises conduits suitable for supplying the lubricant inside the axial support to the slide blocks. The amount of lubricant to be supplied to the bearing surfaces can be influenced by the dimensioning of the flow conduits. This allows also variations caused in the amount of lubricant by the flow resistance in the conduits to be taken into account on the different sides. Further, the conduits can be provided with a throttle to regulate the lubrication.

Figure 6:
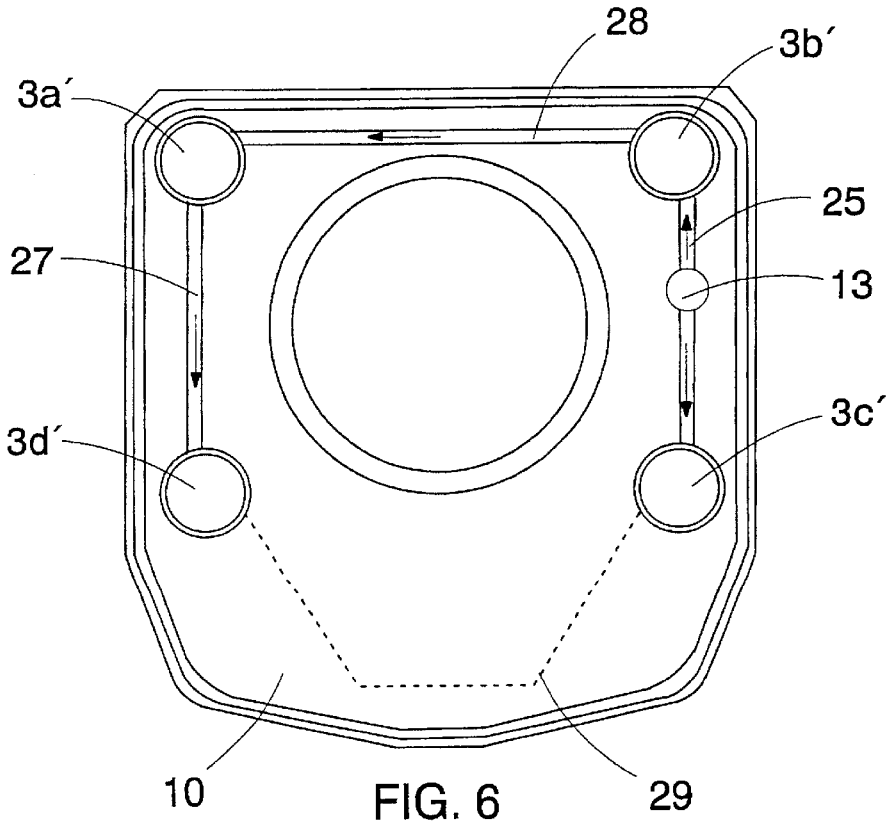

FIG. 6 shows a block the joint surface 10 of which is provided with a transverse groove 28 on which the lubricant is supplied from the upper bolt hole 3*b*′ on the right-hand side to the upper bolt hole 3*a*′ on the left-hand side. A groove 29, for example, shown with a dashed line is also possible. Grooves are relatively simple to make on the joint surface. In addition, a difference from drillings is that no plugging of ends is needed. Another advantage of grooves made to the frontal surface is that grooves pressurized with the lubricant serve at the same time in a way as sealing members and prevent the entry of impurities from the joint surface between the blocks, should the seal between the blocks be damaged.

Figure 7:
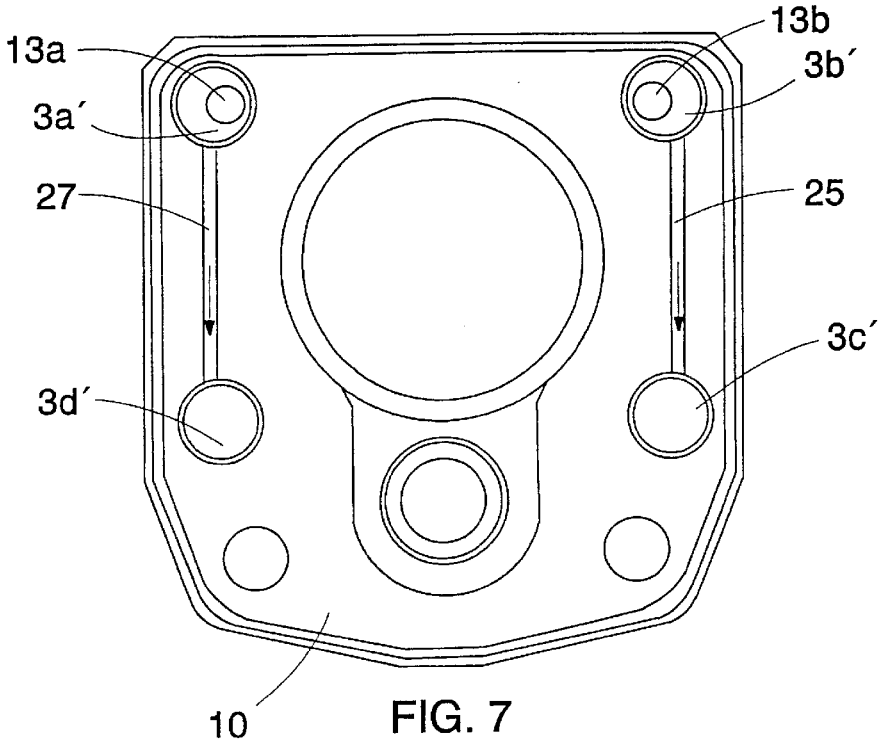

FIG. 7 shows an application similar to that of FIG. 4 where the oil coming from the shank is led in two separate return conduits 13*a* and 13*b* on both sides of the drilling machine to holes 3*a*′ and 3*b*′ of the upper coupling bolts. Here, too, the joint surface 10 is provided with vertical grooves 25 and 27 between the upper and lower coupling bolt holes, but a transverse conduit or groove between the right-hand side and left-hand side bolt holes is not necessarily needed.

Figure 8:
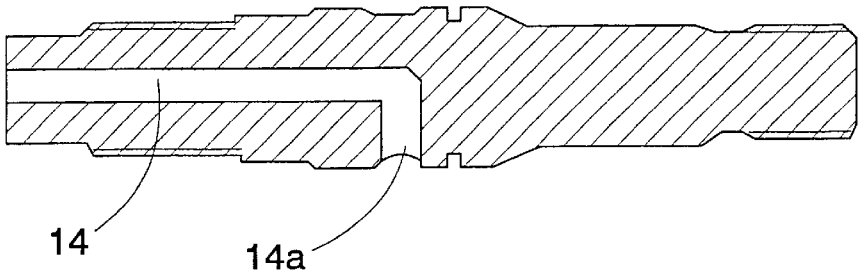
FIGS. 8 and 9 are schematic, sectional side views of coupling bolts.

FIG. 8 shows a coupling bolt comprising a longitudinal conduit 14. The conduit extends approximately to the middle of the bolt and is provided with a transverse conduit 14*a* leading to the outer surface.

FIG. 9 shows another coupling bolt comprising two transverse conduits 14*a* and 14*b*. The use of this type of bolt is described in connection with FIG. 4, for example.

Figure 10:
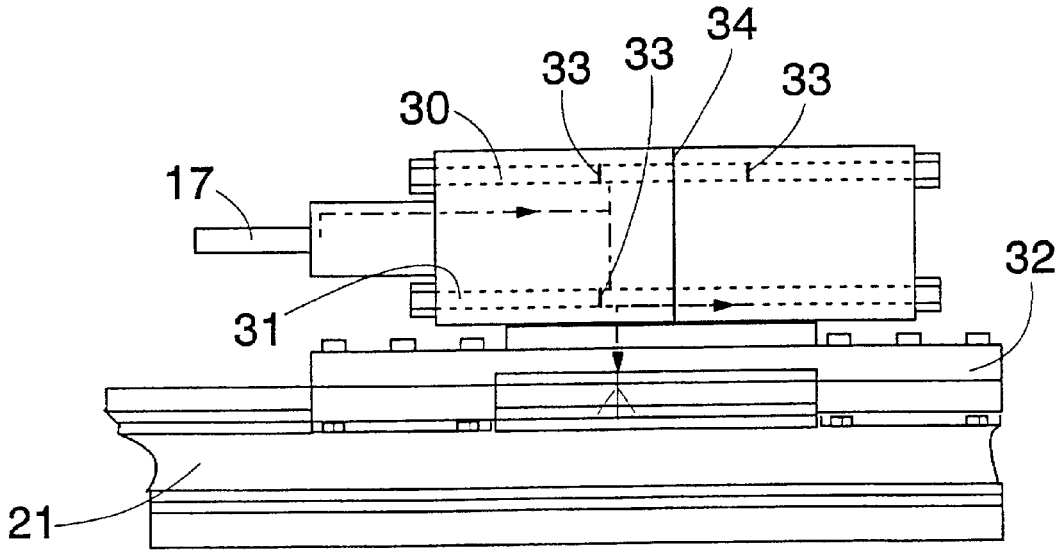
FIG. 10 is a schematic side view of another rock drilling machine in which the invention can be applied.

The invention can also be applied in conventional constructions such as the one shown in FIG. 10 where long binding bolts 30, 31 join the different rock drill blocks to provide an entity, the rock drill being arranged to a carriage 32. Also in this case the oil mist used for lubricating the shank can be led in suitable conduits into the holes of the binding bolts to pressurize the holes. The entire length of the space occupied by the long binding bolt does not have to be pressurized, but seals 33 may be used to define the portion needed (the upper binding bolt), however, preferably such that at least a bolt hole portion extending beyond the joint surface 34 between the blocks is pressurized. When necessary, only the other side (the lower binding bolt) can be sealed, or sealing is not used at all, in which case the lubricant flows outward from the binding bolt space. Also in the last-mentioned cases, impurities are prevented from penetrating into the drilling machine through block seams or under the nut. Furthermore, in a construction employing a carriage to make the rock drill movable with respect to the feed equipment, the lubricant coming from the shank can be supplied in a suitable conduit to the underside of the drilling machine and then through the carriage, in another conduit connected to the previous one, to the bearing surfaces between the feed beam and the carriage.

The drawings and the related specification are only meant to illustrate the inventive idea. The details of the invention may vary within the claims. Consequently, the arrangement of the invention can be applied irrespective of the method of mounting the feed equipment on bearings and the lubricant used. In addition to oil mist, the lubricant may be liquid oil, for example, suitable for the purpose.

What is claimed is:

1. A rock drilling machine, being mounted on bearings to be movable with respect to feed equipment, the drilling machine comprising:

at least two blocks joined together with coupling bolts, a rotating device, a percussion device, a shank, at least one feed conduit for delivering pressurized lubricant to the shank, at least one return conduit for delivering the lubricant used for lubricating the shank from the shank into at least some holes of the coupling bolts, whereby at least some spaces surrounding the coupling bolts are pressurized, and at least one conduit for supplying the lubricant further to lubricate a bearing surface between the rock drilling machine and the feed equipment.

2. A rock drilling machine according to claim 1, wherein the lubricant is supplied in the return conduit directly to a joint surface between the blocks, and the joint surface is provided with one or more grooves for supplying the lubricant on the joint surface from the return conduit to the coupling bolt holes.

3. A rock drilling machine according to claim 1, wherein the coupling bolt comprises a longitudinal conduit and at least one transverse conduit for supplying the lubricant in the a longitudinal direction of the coupling bolt.

4. A rock drilling machine according to claim 1, wherein the rock drilling machine comprises a mounting frame provided with an axial support transverse to the feed equipment for fastening of modules, and the mounting frame is provided with slide blocks comprising slide pieces for mounting the rock drill on bearings with respect to the feed equipment.

5. A rock drilling machine according to claim 4, wherein a module comprising the shank is fastened with one or more coupling bolts to the axial support, the return conduit is connected at least to some of the coupling bolts, the coupling bolts being provided with a longitudinal groove for supplying lubricant from said module to the axial support, and the axial support is provided with a conduit connected to the coupling bolt conduit for supplying the lubricant further to the bearing surface between the rock drill and the feed equipment.

6. A rock drilling machine according to claim 1, wherein the rock drill is mounted to the feed equipment using slide pieces as bearings, and the lubricant is supplied between the slide pieces.

7. A rock drilling machine according to claim 1, wherein the rock drill is mounted to the feed equipment using slide block as a bearing, the slide block being provided with slide pieces, and the slide block is provided with a longitudinal conduit for supplying lubricant to the bearing surface between the slide piece and the feed equipment.

8. A rock drilling machine according to claim 1, wherein the lubricant is oil mist.

* * * * *

UNITED STATES PATENT AND TRADEMARK OFFICE

CERTIFICATE OF CORRECTION

PATENT NO. : 6,732,814 B2
DATED : May 11, 2004
INVENTOR(S) : Jarmo Heinonen et al.

It is certified that error appears in the above-identified patent and that said Letters Patent is hereby corrected as shown below:

Title page,
Item [73], Assignee, please change "Sandvick" to -- Sandvik --.

Signed and Sealed this

Twenty-fourth Day of August, 2004

JON W. DUDAS
*Director of the United States Patent and Trademark Office*